US006477718B1

(12) United States Patent
Wang et al.

(10) Patent No.: US 6,477,718 B1
(45) Date of Patent: Nov. 12, 2002

(54) TOILET FACILITY HAVING IMAGE OR VIDEO DISPLAYER

(76) Inventors: Hsu Yun Wang, P.O. Box 10-69, Chong Ho, Taipei (TW), 235; Han Ming Fu, P.O. Box 10-69, Chong Ho (TW), 235

( * ) Notice: Subject to any disclaimer, the term of this patent is extended or adjusted under 35 U.S.C. 154(b) by 0 days.

(21) Appl. No.: 09/917,713

(22) Filed: Jul. 31, 2001

(51) Int. Cl.[7] ..... A47K 17/00
(52) U.S. Cl. ..... 4/300; 4/661
(58) Field of Search ..... 4/300, 546, 559, 4/661

(56) References Cited

U.S. PATENT DOCUMENTS 3,585,991 A * 6/1971 Balamuth ..... 4/559
5,978,975 A * 11/1999 Asskaryar ..... 4/661 X

FOREIGN PATENT DOCUMENTS

| | | | |
|---|---|---|---|
| JP | 61263 | * 3/1990 | ..... 4/559 |
| JP | 279844 | * 11/1990 | ..... 4/300 |
| JP | 4285511 | * 10/1992 | ..... 4/546 |
| JP | 5115388 | * 5/1993 | ..... 4/546 |

* cited by examiner

*Primary Examiner*—Robert M. Fetsuga

(57) ABSTRACT

A toilet device includes one or more toilets, and a displayer device disposed above each of the toilets for displaying photo images or video programs or the like, while the users are using the toilets. The displayer device may include a screen for displaying the photo image or the video program from such as the tape or compact disc displayer. A processor unit may receive and send the radio or video signals to the displayer device. A detector may be used to detect the users and to actuate the displayer device and to flush the toilets.

1 Claim, 5 Drawing Sheets

TOILET FACILITY HAVING IMAGE OR VIDEO DISPLAYER

BACKGROUND OF THE INVENTION

1. Field of the Invention

The present invention relates to a toilet, and more particularly to a toilet facility having an image displayer or a screen or a monitor or a television or the like for showing the images or the video tapes or programs.

2. Description of the Prior Art

Typical toilet facilities comprise one or more toilets, or toilet bowls, or toilet stools or the like attached to the walls or the ground. Some of the toilets may include a sensor or a detector attached to the upper or front portion thereof for detecting whether the toilet has been used or not and for flushing the toilet after use. No image displayers or monitors may be provided for showing the photos, or for showing the programs of the televisions or video tapes or the like.

The present invention has arisen to mitigate and/or obviate the afore-described disadvantages of the conventional toilet facilities.

SUMMARY OF THE INVENTION

The primary objective of the present invention is to provide a toilet facility including an image displayer or a screen or a monitor or a television or the like for showing the images or the video tapes or programs.

In accordance with one aspect of the invention, there is provided a toilet facility comprising one or more toilets, and a displayer device disposed above each of the toilets for displaying photo images or video programs or the like, while the users are using the toilets.

The displayer device includes a screen for displaying the photo image or the video program.

A tape recorder device or a compact disc displayer or the like may further be coupled to the displayer device for sending a video program to the displayer device.

A processor unit may further be provided and coupled to the displayer device for receiving the radio or video signals and for sending the video signals to the displayer device.

A receiver may further be provided for receiving a radio or a video signal and for sending the signal to the displayer device.

A switch box may further be provided and coupled to the displayer device, and coupled to the tape recorder and the compact disc displayer and/or a digital disc displayer and/or an interface, and/or a television station for switching the radio and/or the video signals to the displayer device.

A device may further be provided for actuating the displayer device, and includes a detector coupled to the displayer device, for detecting a user and for actuating the displayer device.

The detector may also be used to actuate a flush tank to flush the toilets when the detector has detected that a user is using the toilet.

One or more speakers may further be provided for presenting a radio program from such as a radio station or the like, and may be coupled to the switch box which may selectively sending the radio signals to the speakers.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
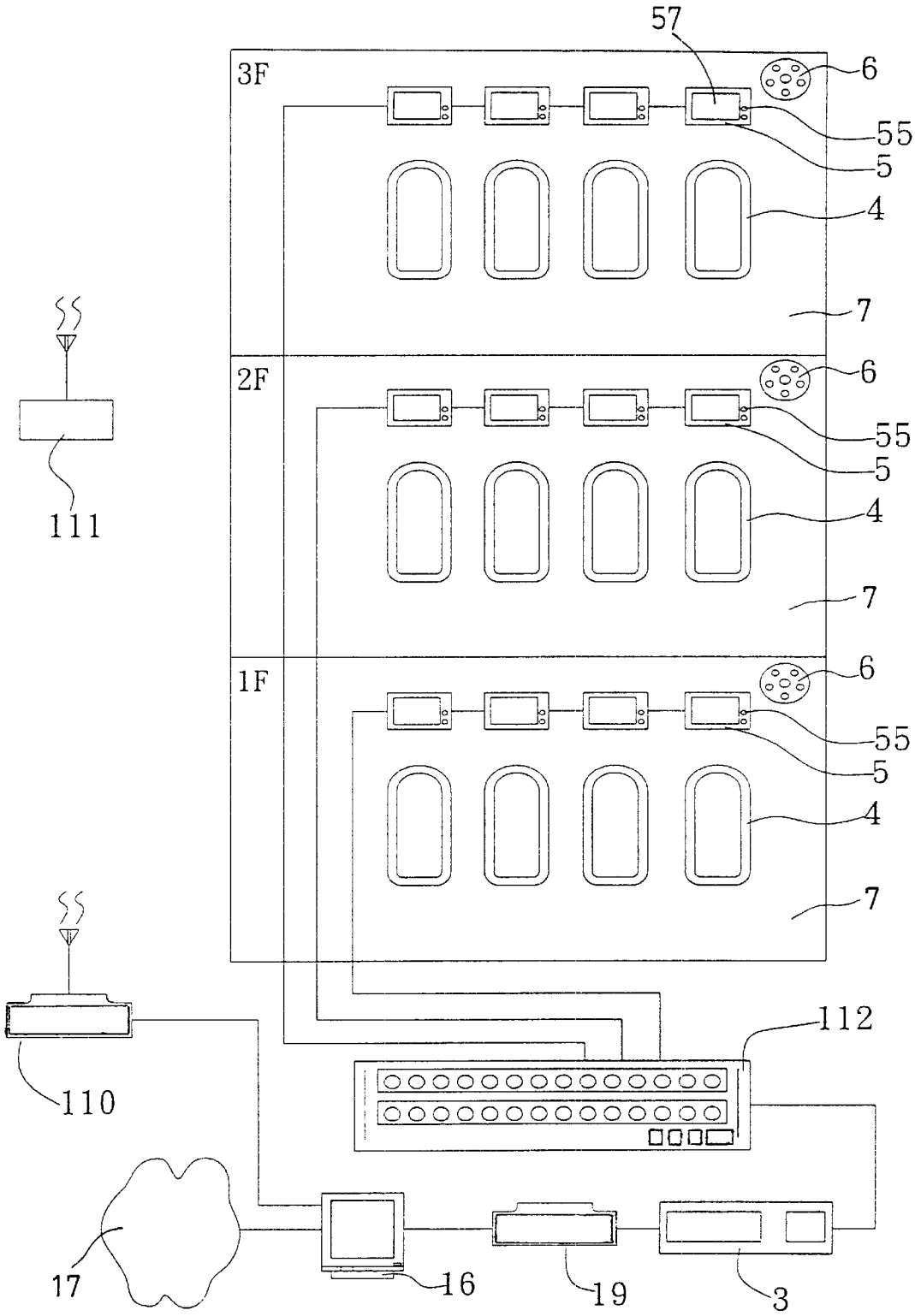
FIG. 1 is a plane schematic view of a toilet facility in accordance with the present invention.
Figure 2:
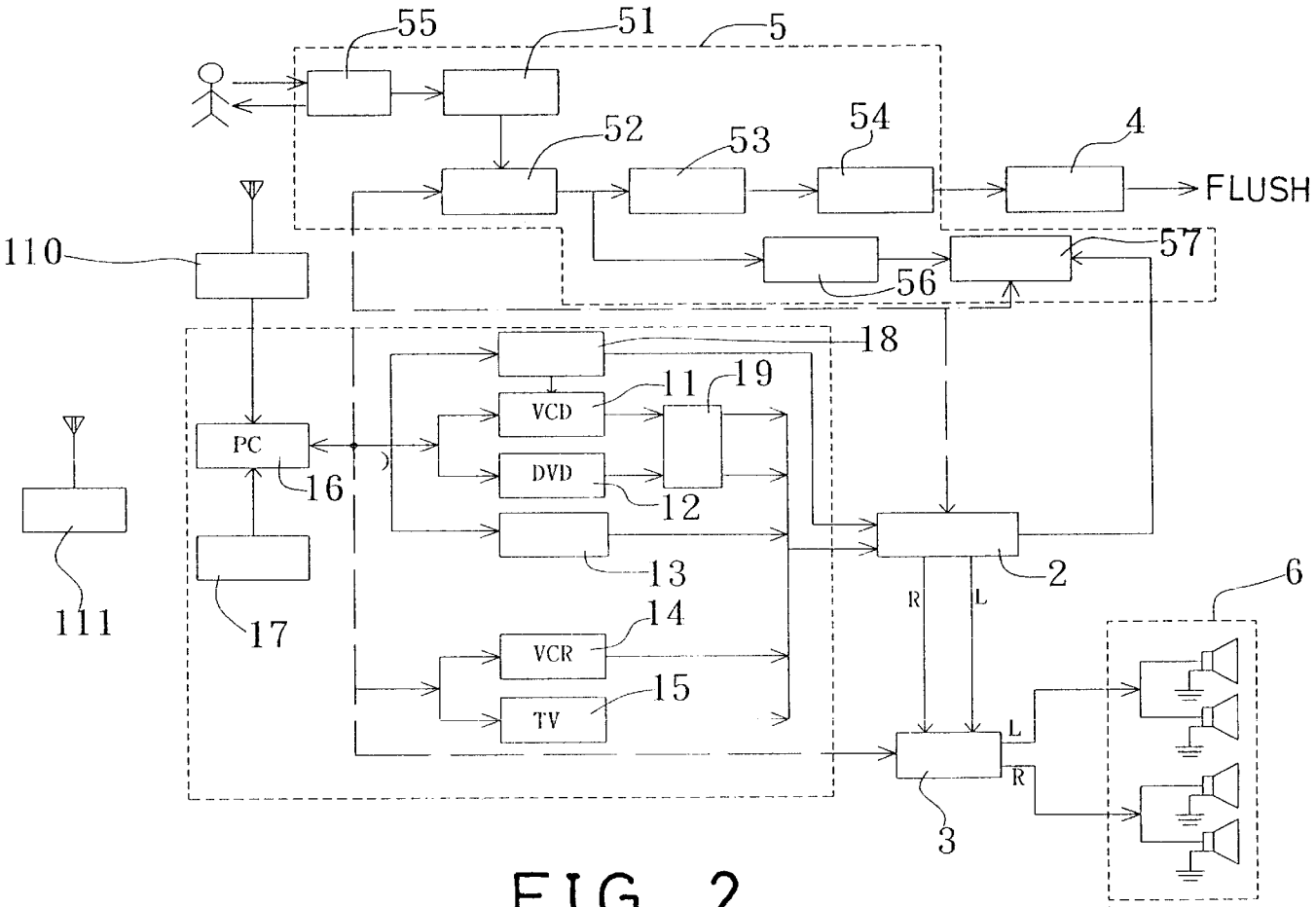
FIG. 2 is a block diagram showing the system of the toilet facility.
Figure 3:
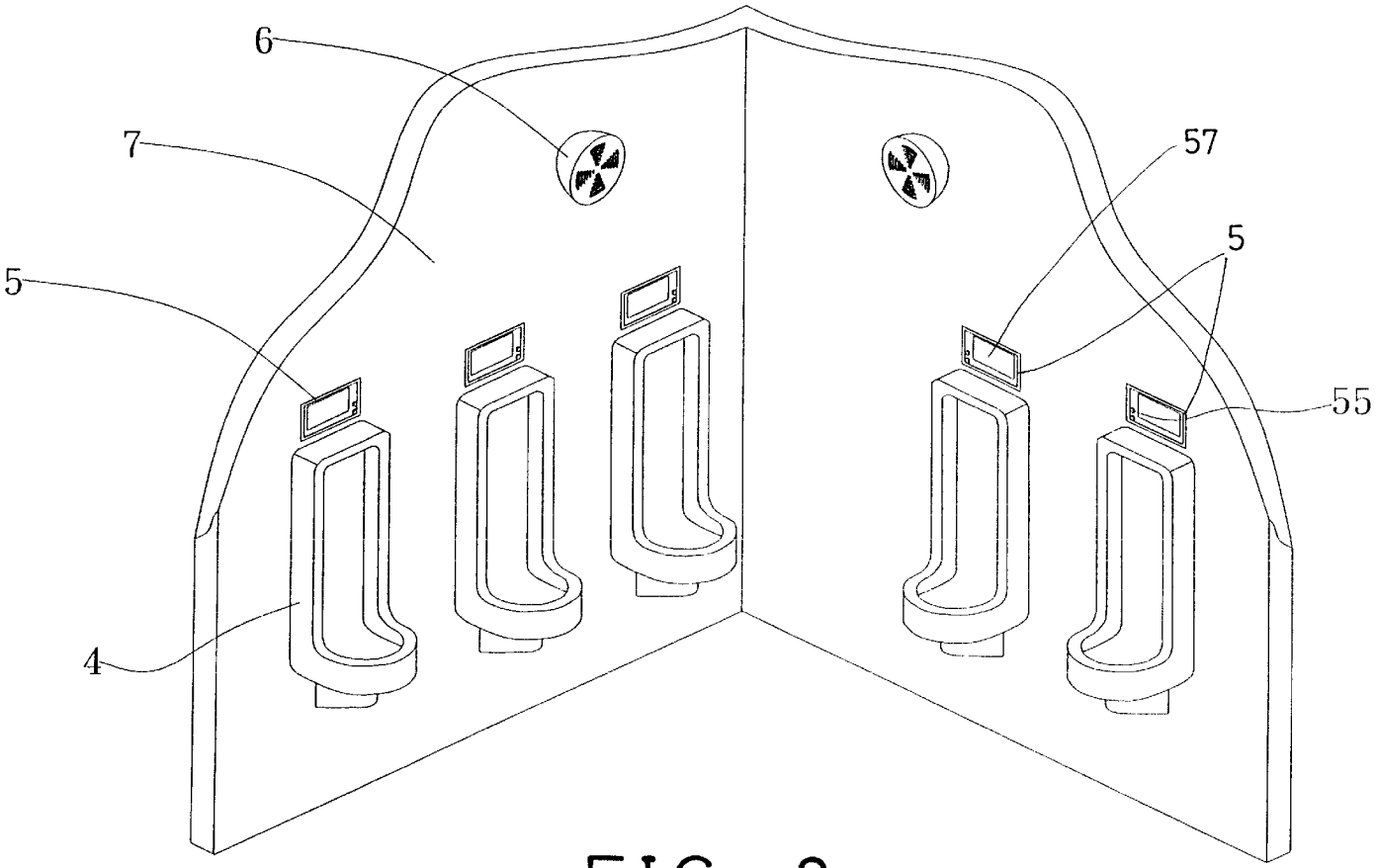
FIGS. 3, 4, 5 are partial perspective views illustrating the operation and the arrangement of the toilet facility.
Figure 4:
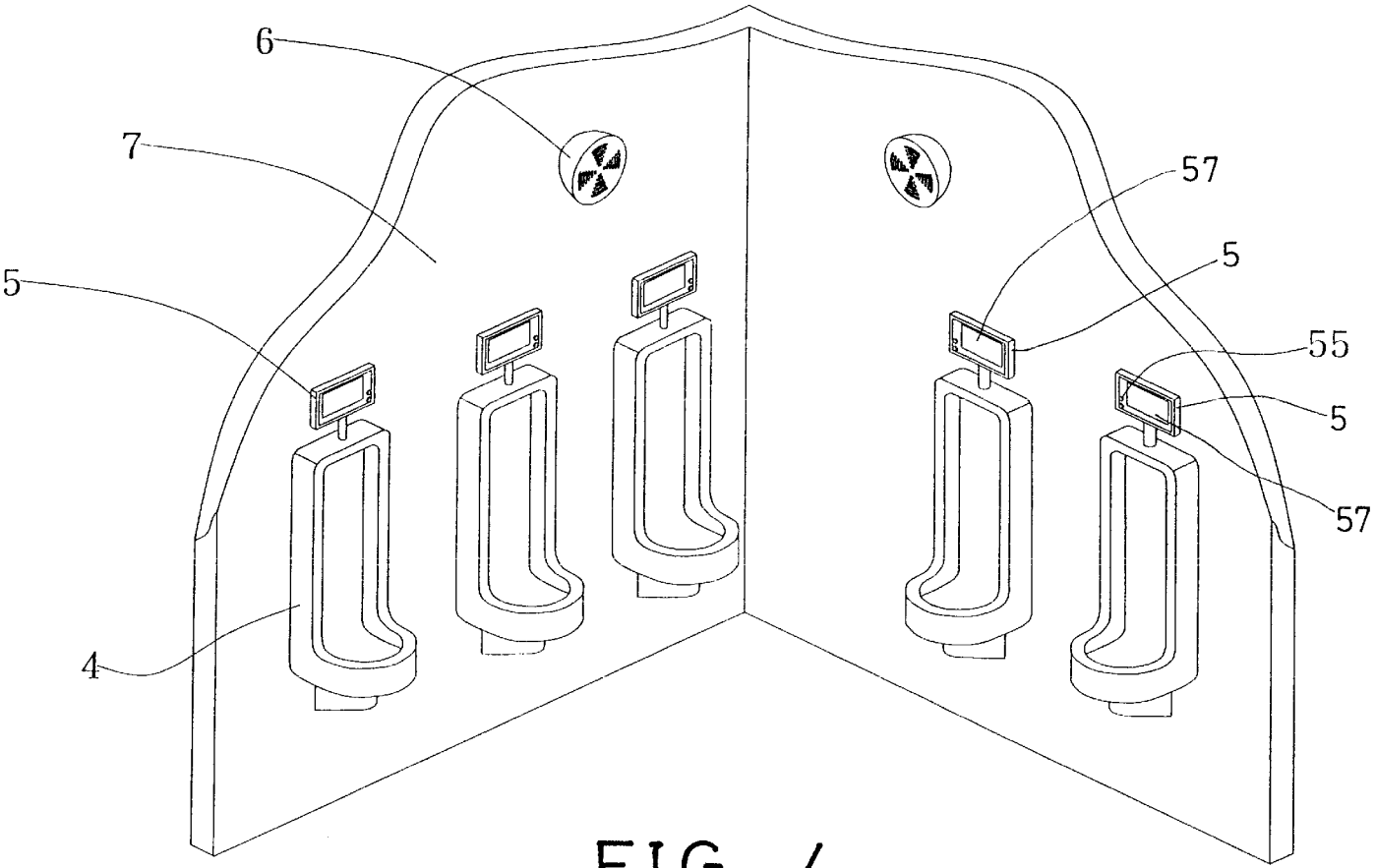
Figure 5:
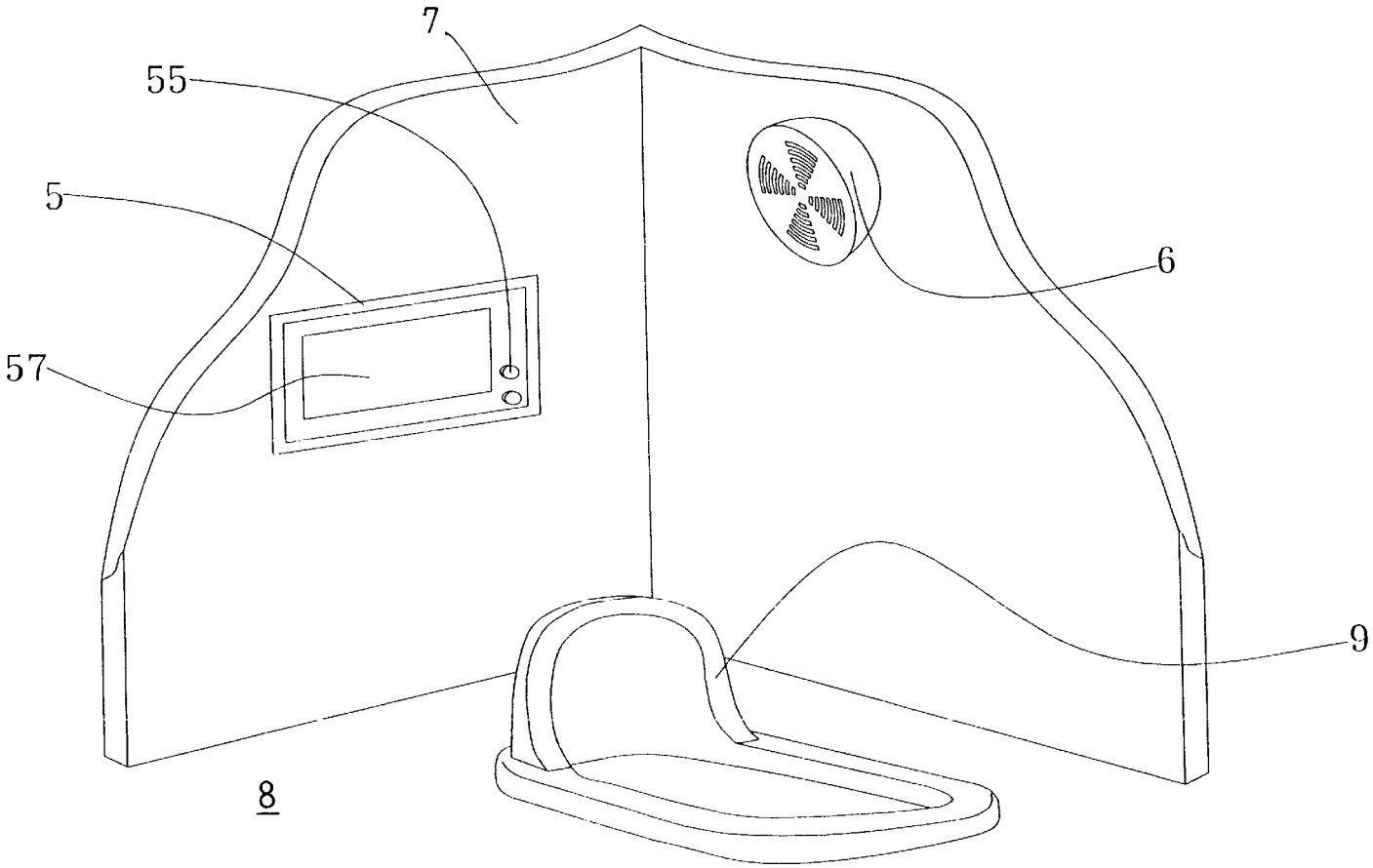

Referring to the drawings, and initially to FIGS. 1–3, a toilet facility in accordance with the present invention comprises one or more toilets 4, or toilet bowls, or toilet stools 9 (FIG. 5) or the like attached to the walls 7 or the ground 8 (FIG. 5). An image displayer device 5 or a monitor or a screen or the like is provided and attached to the upper or front portion of the toilet 4, 9 for showing the images of the photos, or for showing the television programs or for displaying the video tapes or the video compact discs or the like. The users may thus appreciate the images or the programs while using the toilets. As shown in FIGS. 1, 3, 5, the displayer devices 5 may be directly attached to the wall 7. As shown in FIG. 4, the displayer devices 5 may be attached or disposed on top of the toilets 4 instead of being disposed or attached to the wall 7.

A sensor or a detector 55 is attached to the upper or front portion of each of the toilets 4, 9. For example, the detector 55 may be directly attached or disposed onto the wall 7, or disposed or provided in the displayer devices 5, for detecting whether the toilet has been used or not and for flushing the toilet after use, and/or for actuating or controlling the operation of the displayer devices 5. The detectors 55 may be the typical infra red rays detectors or the like, for detecting that a user is standing in front of the toilet 4 or is using the toilet 4, 9. The displayer devices 5 each includes a screen 57 for showing the photo images or the video programs. One or more speakers 6 may be attached onto the wall 7 for displaying or presenting the musics or the sounds or the like.

As shown in FIGS. 1 and 2, the toilet facility comprises a processor unit or a personal computer (PC) 16, and a switch box 2 coupled to the screens 57 of the displayer devices 5 and coupled to the speakers 6 directly or indirectly via the amplifier 3 or the like. A video tape recorder 14 and/or a television 15 may be directly coupled between the PC 16 and the switch box 2 for selectively sending the images or video programs from the video tape recorder 14 and/or the television 15 to the displayer devices 5 and/or the speakers 6 via the switch box 2. A video compact disc displayer 11 and/or a digital compact disc displayer 12 may be directly coupled between the PC 16 and the switch box 2, or indirectly coupled to the switch box 2 via an amplifier or a wave enhancer 19 or the like, for selectively sending the images or video programs to the displayer devices 5 and/or the speakers 6 via the switch box 2.

An interface 18 or a radio device 13 may be coupled between the PC 16 and the switch box 2 for selectively sending the radio programs to the speakers 6. The PC 16 may be coupled to the internet 17 or coupled to a receiver 110 for receiving the radio and/or video programs from the radio stations or the video stations 111, and for selectively sending the radio programs or the images or the video programs to the displayer devices 5 and/or the speakers 6. As shown in FIG. 1, a signal distributing device 112 may be coupled between the PC 16 and/or the amplifier 3 and the displayer devices 5 and the speakers 6, for selectively showing the selected programs or images in the displayer devices 5 and the speakers 6.

As shown in FIG. 2, a detecting circuit 51 and a control circuit 52 and a driving circuit 53 are coupled to the detector (s) 55, and are coupled to an electromagnetic valve 54 or the like, in order to actuate the typical flush tank to flush the toilet 4 after use. The control circuit 52 may be directly coupled to the screen 57 of the displayer device 5 or indirectly coupled to the screen 57 of the displayer device 5 via a switch 56, for selectively actuating the screen 57 of the displayer device 5.

The screen 57 of the displayer device 5 may thus be used to show or to display the images of the photos or the video programs when the detectors 55 have detected that a user is standing in front of the toilet 4, 9 or is using the toilet 9. The users may thus appreciate the musics or the video programs whiling using the toilet facilities.

Accordingly, the toilet facility in accordance with the present invention includes an image displayer or a screen or a monitor or a television or the like for showing the images or the video tapes or programs.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A toilet facility comprising:

a plurality of toilets, a plurality of displayer devices disposed above said toilets respectively for displaying purposes, said displayer devices each including a screen for displaying images and video programs, a plurality of detectors coupled to said displayer devices respectively, for detecting users and for actuating said displayer devices respectively, a processor unit coupled to said displayer devices, at least one speaker coupled to said processor unit for presenting radio programs, a switch box coupled between said displayer devices and said at least one speaker, a tape recorder, a compact disc displayer, and a digital disc displayer coupled to said processor unit for sending video programs to said displayer devices respectively, and a receiver for receiving signals and for sending the signals to said displayer devices.

* * * * *